US010278277B2

(12) United States Patent
Kleeven et al.

(10) Patent No.: US 10,278,277 B2
(45) Date of Patent: Apr. 30, 2019

(54) GRADIENT CORRECTOR FOR CYCLOTRON

(71) Applicant: Ion Beam Applications, S.A., Louvain-la-Neuve (BE)

(72) Inventors: Willem Kleeven, Pellenberg (BE); Szymon Zaremba, Belgrade (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 175 days.

(21) Appl. No.: 15/594,534

(22) Filed: May 12, 2017

(65) Prior Publication Data

US 2017/0332471 A1 Nov. 16, 2017

(30) Foreign Application Priority Data

May 13, 2016 (EP) ..... 16169489
May 13, 2016 (EP) ..... 16169490
(Continued)

(51) Int. Cl.
*H05H 13/00* (2006.01)
*H05H 9/00* (2006.01)
(Continued)

(52) U.S. Cl.
CPC ..... *H05H 7/10* (2013.01); *H01F 3/10* (2013.01); *H01F 7/02* (2013.01); *H01F 7/20* (2013.01);
(Continued)

(58) Field of Classification Search
CPC .. H05H 9/00; H05H 7/00; H05H 7/02; H05H 7/18; H05H 5/00; H05H 7/04;
(Continued)

(56) References Cited

U.S. PATENT DOCUMENTS 3,389,308 A 8/1968 Steimel
5,739,646 A * 4/1998 Nakanishi ..... H05H 7/00 313/62
(Continued)

FOREIGN PATENT DOCUMENTS

EP 1 069 809 A1 1/2001
FR 2 234 733 1/1975
(Continued)

OTHER PUBLICATIONS

European Search Report dated Nov. 2, 2016, 6 pages.

*Primary Examiner* — Minh D A
(74) *Attorney, Agent, or Firm* — Finnegan, Henderson, Farabow, Garrett & Dunner LLP

(57) ABSTRACT

The present disclosure relates to a magnet pole for an isochronous sector-focused cyclotron having hill and valley sectors alternatively distributed around a central axis, Z, each hill sector having an upper surface bounded by four edges: an upper peripheral edge, an upper central edge, a first and a second upper lateral edges, and a peripheral surface extending from the upper peripheral edge to a lower peripheral line. The upper peripheral edge of at least one hill sector may further include a concave portion with respect to the central axis defining a recess extending at least partially over a portion of the peripheral surface of the corresponding hill sector.

20 Claims, 8 Drawing Sheets

(30) Foreign Application Priority Data

May 13, 2016 (EP) ..... 16169494
May 13, 2016 (EP) ..... 16169497

(51) Int. Cl.

| | |
|---|---|
| ***H05H 7/10*** | (2006.01) |
| ***H05H 7/04*** | (2006.01) |
| ***H01F 7/02*** | (2006.01) |
| ***H05H 7/00*** | (2006.01) |
| ***H05H 13/08*** | (2006.01) |
| ***H01F 3/10*** | (2006.01) |
| ***H01F 7/20*** | (2006.01) |

(52) U.S. Cl.
CPC ..... *H05H 7/001* (2013.01); *H05H 7/04* (2013.01); *H05H 13/005* (2013.01); *H05H 13/08* (2013.01); *H05H 2007/002* (2013.01); *H05H 2007/043* (2013.01)

(58) Field of Classification Search
CPC ..... H05H 11/00; H05H 7/06; H05H 13/00; H05H 7/10; H05H 7/08; H05H 13/02; H05H 13/04; H05H 9/04; H05H 5/04; H05H 5/02; H05H 5/06; H05H 1/24; G21K 1/093; H01J 25/00; B03C 3/68
See application file for complete search history.

(56) References Cited

U.S. PATENT DOCUMENTS

2010/0282979 A1* 11/2010 Norling ..... H05H 7/00 250/396 ML
2014/0042934 A1* 2/2014 Tsutsui ..... H05H 13/02 315/502

FOREIGN PATENT DOCUMENTS

| | | |
|---|---|---|
| JP | 57-159000 | 9/1982 |
| JP | 11-238599 | 8/1999 |
| RU | 2 373 673 C1 | 11/2009 |

* cited by examiner

GRADIENT CORRECTOR FOR CYCLOTRON

This application claims the benefit of priority of European Patent Application No. 16169489.8, filed on May 13, 2016, European Patent Application No. 16169490.6, filed on May 13, 2016, European Patent Application No. 16169494.8, filed on May 13, 2016, and European Patent Application No. 16169497.1, filed on May 13, 2016, all of which are incorporated herein by reference.

TECHNICAL FIELD

The present disclosure relates to cyclotrons. In particular, it relates to isochronous sector-focused cyclotrons having enhanced focusing of an extracted beam of energized charged particles.

TECHNICAL BACKGROUND

A cyclotron is a type of circular particle accelerator in which negatively or positively charged particles are accelerated outwards from the centre of the cyclotron along a spiral path up to energies of several MeV. Unless otherwise indicated, the term "cyclotron" is used in the following to refer to isochronous cyclotrons. Cyclotrons are used in various fields, for example in nuclear physics, in medical treatment such as proton-therapy, or in radio-pharmacy. In particular, cyclotrons can be used for producing short-lived positron-emitting isotopes suitable for PET imaging (positron emitting tomography) or for producing gamma-emitting isotopes, for example, Tc99m, for SPECT imaging (single photon emission computed tomography).

A cyclotron generally comprises several elements including an injection system, a radiofrequency (RF) accelerating system for accelerating the charged particles, a magnetic system for guiding the accelerated particles along a precise path, an extraction system for collecting the thus accelerated particles, and a vacuum system for creating and maintaining a vacuum in the cyclotron.

A particle beam constituted of charged ions is introduced into a gap at or near the center of the cyclotron by the injection system with a relatively low initial velocity. As illustrated in FIG. 3, this particle beam is sequentially and repetitively accelerated by the RF accelerating system and guided outwards along a spiral path comprised within the gap by the magnetic field generated by the magnetic system. When the particle beam reaches its target energy, it can be extracted from the cyclotron by the extraction system provided at a point of extraction, PE. This extraction system can comprise, for example, a stripper consisting of a thin sheet of graphite. For example, $H^-$ if ions passing through the stripper lose two electrons and become positive. Consequently, the curvature of their path in the magnetic field changes its sign, and the particle beam is thus led out of the cyclotron towards a target. Other extracting systems exist which are well known to the persons skilled in the art.

The magnetic system generates a magnetic field that guides and focuses the beam of charged particles along the spiral path until it is accelerated to its target energy. In the following, the terms "particles", "charged particles", and "ions" are used indifferently as synonyms. The magnetic field is generated in the gap defined between two magnet poles by two solenoid coils, 14, wound around these poles. Magnet poles of cyclotrons are often divided into alternating hill sectors and valley sectors distributed around a central axis. The gap between two magnet poles is smaller at the hill sectors and the larger at the valley sectors. A strong magnetic field is thus created in the hill gap portions within the hill sectors and a weaker magnetic field is created in the valley gap portions within the valley sectors. Such azimuthal magnetic field variations provide radial and vertical focusing of the particle beam every time the particle beam reaches a hill gap portion. For this reason, such cyclotrons are sometimes referred to as sector-focusing cyclotrons. In some embodiments, a hill sector has a geometry of a circular sector similar to a slice of cake with a first and second lateral surfaces extending substantially radially towards the central axis, a generally curved peripheral surface, a central surface adjacent to the central axis, and an upper surface defining one side of a hill gap portion. The upper surface is delimited by a first and second lateral edges, a peripheral edge, and a central edge.

In practice, a particle beam has a cross sectional area. An objective of cyclotrons is to produce charged particle beams having a given energy which are as much focused as possible (i.e. having a small cross sectional area). The variations of the magnetic field created by the succession of hill sectors and valley sectors contributes to the focusing of the beam in a similar way as a light beam can be focused by lenses. Upon extraction of the particle beam out of the gap defined between two magnet poles, however, the particle beam crosses boundary regions where the magnetic field loses its homogeneity, which is detrimental to the focusing of the particle beam. This is a particularly sensitive issue because, on the one hand, the particle beam has its highest energy at the point of extraction and, on the other hand, it is more difficult to control the magnetic field at the peripheral edges of the magnet poles where the magnetic field drops rapidly. To enhance the focusing of an extracted particle beam, it has been proposed in the art to modify the geometry of the peripheral edges of hill sectors by forming protrusions to said peripheral edges by addition of gradient correctors. Gradient correctors are relatively small blocks of steel with respect to the size of a hill sector, which are coupled to the peripheral surfaces of the hill sectors. Such gradient correctors allow the modification of the magnetic field near the peripheral edges and thus locally modify the magnetic field near the peripheral edge of a hill sector to improve the focusing of the outgoing particle beam. The use of protruding gradient correctors has, however, several drawbacks. First, the volume of the vacuum chamber hosting the magnet poles must be increased accordingly, thus requiring more energy and time to pump the gases from the vacuum chamber. Second, the overall weight of the cyclotron is increased because of, on the one hand, the weight of the gradient correctors themselves and, on the other hand, the increased overall size of the outer walls of the vacuum chamber and, consequently, the size of the flux return yoke; both contributing to a substantial increase of the cyclotron weight. Third, the position of the protruding gradient correctors is essential; small deviations of position may yield large variations of the magnetic field. Gradient correctors must be fixed manually by a skilled artisan at precisely the same position of the peripheral surface of all the hill sectors. This is of course, a critical and expensive operation. Fourth, these protruding gradient correctors have the effect of deviating the magnetic field outwards, which pulls outwards the path of the particle beam towards the peripheral edge of a hill gap portion between a pair of opposed hill sectors where the magnetic field loses its homogeneity. This shift also leads to a loss of useful magnetic field and thus requires an increase of the coil current in order to compensate this loss.

It is therefore more difficult and expensive to control the properties of the extracted particle beam.

There therefore remains a need in the art to provide an isochronous sector-focused cyclotron allowing the extraction of a more focused and more predictable particle beam in an efficient and cost effective manner.

SUMMARY

Embodiments of the present disclosure are defined in the appended independent claims. Further embodiments are defined in the dependent claims.

Embodiments of the present disclosure relate to a magnet pole for a cyclotron comprising at least 3 hill sectors and a same number of valley sectors comprising a bottom surface, said hill sectors and valley sectors being alternatively distributed around a central axis, Z, each hill sector comprising:

(a) an upper surface defined by:
- an upper peripheral edge, said upper peripheral edge being bounded by a first and a second upper distal ends, and being defined as the edge of the upper surface located furthest from the central axis;
- an upper central edge, said upper central edge being bounded by a first and a second upper proximal ends and being defined as the edge of the upper surface located closest from the central axis;
- a first upper lateral edge connecting the first upper distal end and first upper proximal end;
- a second upper lateral edge connecting the second upper distal end and second upper proximal end;

(b) a first and second lateral surfaces each extending transversally from the first and second upper lateral edges, to the bottom surfaces of the corresponding valley sectors located on either sides of a hill sector, thus defining a first and second lower lateral edges as the edges intersecting a lateral surface with an adjacent bottom surface, said first and second lower lateral edges each having a lower distal end located furthest from the central axis;

(c) a peripheral surface extending from the upper peripheral edge to a lower peripheral line defined as the segment bounded by the lower distal ends of the first and second lower lateral edges;

characterised in that, the upper peripheral edge of at least one hill sector comprises a concave portion with respect to the central axis defining a recess extending at least partially over a portion of the peripheral surface of the corresponding hill sector.

In some embodiments, the recess is generally wedge-shaped with a first and second converging lines (preferably straight lines) extending away from the upper peripheral edge, with a converging angle, 0, that may be between 70° and 130°, for example, between 80° and 110° or 90°±5°.

The recess may have a converging portion, away from the upper peripheral edge, said converging portion having one of the following geometry:

a sharp corner forming a triangular recess;

a straight edge forming a trapezoidal recess; or a rounded edge forming an arched recess.

In some embodiments, the upper peripheral edge has an azimuthal length, Ah, and the concave portion may extend between 3% and 30% of the azimuthal length of the upper peripheral edge, for example, between 5% and 20% or between 8% and 15%.

In some embodiments, the recess is separated from the first and second upper lateral edges. Alternatively, the recess may be adjacent to the first upper lateral edge.

The recess may extend over a portion of the peripheral surface.

In some embodiments, the portion of the peripheral surface correspond to a fraction, ζ, of the height of the peripheral surface measured parallel to the central axis between the upper peripheral edge and the lower peripheral line, wherein the fraction, ζ, may be between 25% and 75%, for example, between 40% and 60% or between 45% and 55%.

In order to have smooth variations of the magnetic field, the peripheral surface may form a chamfer adjacent to the upper peripheral edge.

In some embodiments, the upper peripheral edge is an arc of a circle whose centre is offset with respect to the central axis, and whose radius is not more than 85% of a distance from the central axis to a midpoint of the upper peripheral edge, which may be equidistant to the first and second upper distal ends.

The number, N, of hill sectors may be 3, 4, 5, 6, 7, or 8, for example, N=4.

The present disclosure also relates to a cyclotron for accelerating a particle beam over a given path comprised within a gap, said cyclotron comprising first and second magnet poles such as described above, wherein the first and second magnet poles are positioned symmetrically with respect to a median plane normal to the central axes of first and second magnet pole forming said gap in between, with hill gap portion being formed between two opposite hill sectors and valley gap portions being formed between two opposite valley sectors.

In some embodiments, the recess of a cyclotron has a first and a second recess distal points, said first and second recess distal points being separated from one another by a distance L10, and wherein the hill gap portion between a pair of hill sectors of the first and second magnet poles has an average height, Gh, and wherein the ratio Gh/L10 may be between 5% and 100%, for example, between 10% and 50% or 20% and 33%.

The cyclotron may also comprise a point of extraction, located in a hill gap portion between two opposite upper surfaces of hill sectors of the first and second magnet poles, wherein the given path of the particle beam is an outward spiral path cycling about the central axis until said first point of extraction whence the particle beam can be driven out of the cyclotron with a given energy along an extraction path, and wherein the recess is located downstream from said point of extraction wherein downstream is defined with respect to the direction of the particle beam, such that the extraction path crosses on line of the recess with an angle between 80° and 100°, for example, between 85° and 95°.

In some embodiments, the cyclotron further comprises a second point of extraction in a hill sector defining a second extraction path, and comprising a second recess located downstream from the second point of extraction, such that the second extraction path crosses one line of the second recess with an angle between 80° and 100°, for example, between 85° and 95°.

SHORT DESCRIPTION OF THE DRAWINGS

These and further aspects of the present disclosure will be explained in greater detail by way of example and with reference to the accompanying drawings in which:

FIG. 1A schematically shows a side cut view and of a cyclotron according to example embodiments of the present disclosure.

FIG. 1B schematically shows a top view of a cyclotron according to example embodiments of the present disclosure.

DETAILED DESCRIPTION

Geometry of a Cyclotron

Figure 3:
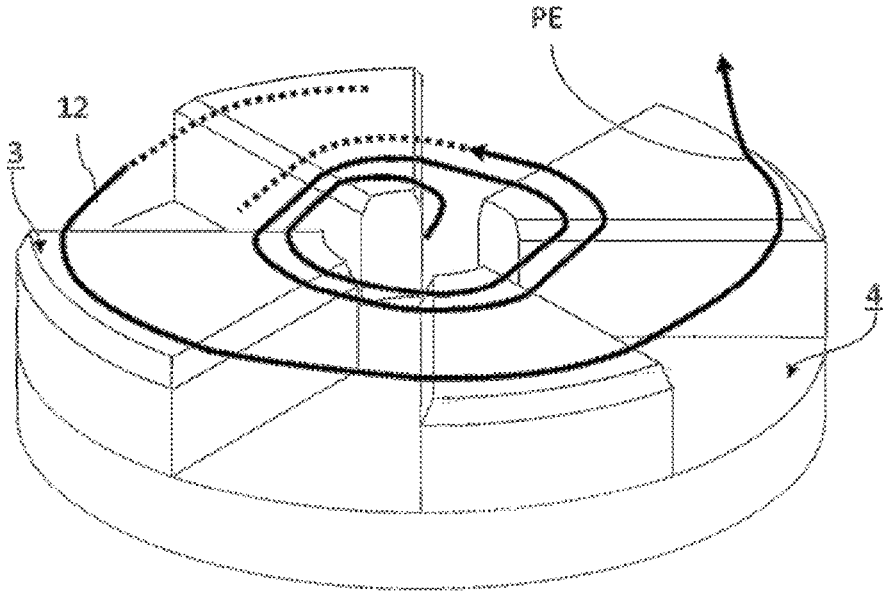
FIG. 3 shows a partial perspective view of a half cyclotron and the path of accelerates charged particles (the outlets for the extracted particles in the flux return yokes are not shown for enhancing visibility).

The present disclosure relates to isochronous sector-focused cyclotrons, hereafter referred to as cyclotron of the type discussed in the technical background section supra. As illustrated in FIG. 3, a cyclotron according to embodiments of the present disclosure accelerates charged particles outwards from a central area of the cyclotron along a spiral path 12 until they are extracted at energies of several MeV. For example, the charged particles thus extracted can be protons, $H^+$, or deuteron, $D^+$. In certain aspects, the energy reached by the extracted particles is comprised between 5 and 30 MeV, for example, between 15 and 21 MeV, or, by way of further example, 18 MeV. Cyclotrons of such energies are used, for example, for producing short-lived positron-emitting isotopes suitable for use in PET imaging (positron emitting tomography) or for producing gamma-emitting isotopes, for example, Tc99m, for SPECT imaging (single photon emission computed tomography).

Figure 1A:
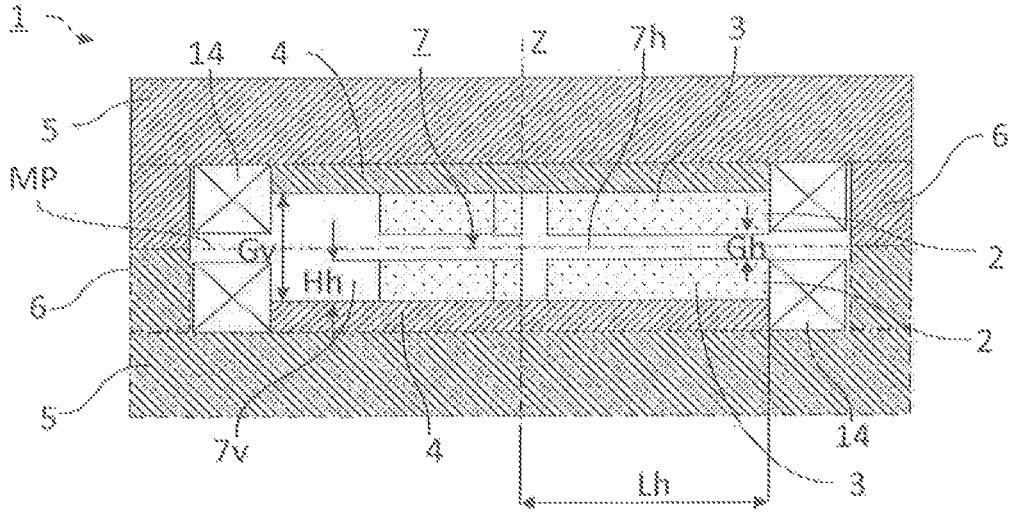

As illustrated in FIG. 1A, a cyclotron 1 according to an embodiment of the present disclosure comprises two base plates 5 and flux return yokes 6 which, together, form a yoke. The flux return yokes form the outer walls of the cyclotron and control the magnetic field outside of the coils 14 by containing it within the cyclotron. It further comprises first and second magnet poles 2 located in a vacuum chamber, facing each other symmetrically with respect to a median plane MP normal to a central axis, Z, and separated from one another by a gap 7. The yoke and the magnet poles are all made of a magnetic material, for example, a low carbon steel and form a part of the magnetic system. The magnetic system is completed by a first and second coils 14 made of electrically conductive wires wounded around the first and second magnet poles and fitting within an annular space defined between the magnet poles and the flux return yokes.

Figure 1B:
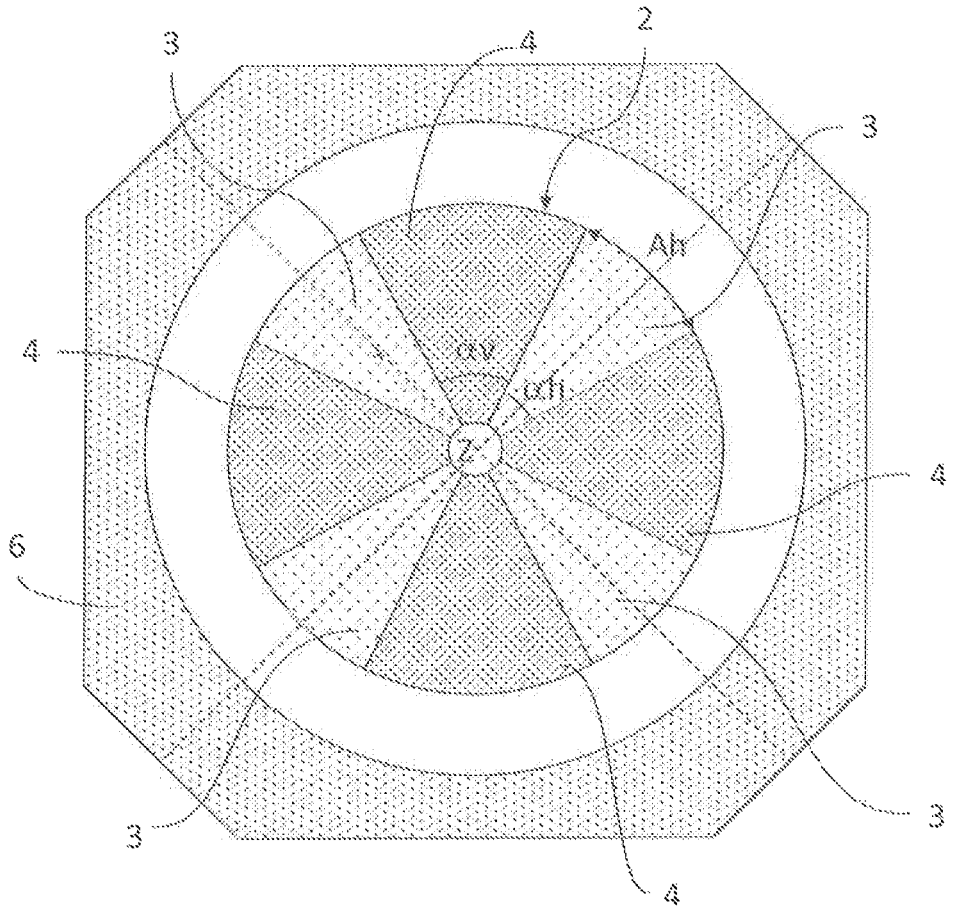
Figure 2:
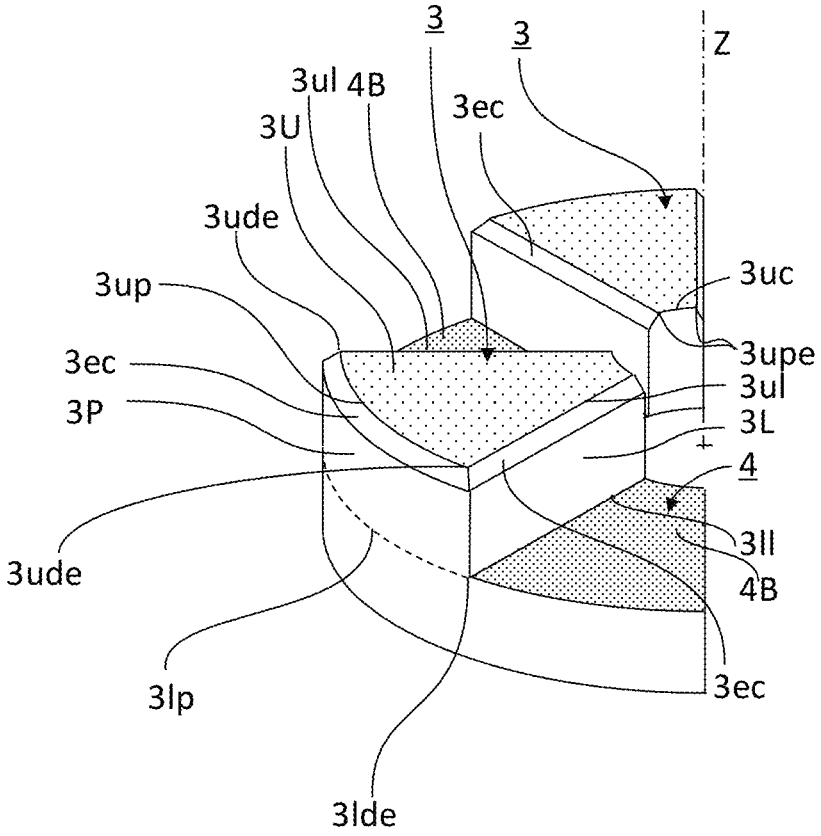
FIG. 2 shows an example of hill and valley sectors of a cyclotron according to example embodiments of the present disclosure.

As illustrated in FIG. 1B and FIG. 2, each of the first and second magnet poles 2 comprises at least N=3 hill sectors 3 distributed radially around the central axis, Z (FIG. 1B illustrates one embodiment with N=4). Each hill sector 3, represented in FIG. 1B as light shaded areas, has an upper surface 3U extending over a hill azimuthal angle, $\alpha h$. Each of the first and second magnet poles 2 further comprises the same number, N, of valley sectors 4, represented in FIG. 1B as dark shaded areas, distributed radially around the central axis Z. Each valley sector 4 is flanked by two hill sectors 3 and has a bottom surface 4B extending over a valley azimuthal angle, $\alpha v$, such that $\alpha h+\alpha v=360°/N$.

The hill sectors 3 and valley sectors 4 of the first magnet pole 2 face the opposite hill sectors 3 and valley sectors 4, respectively, of the second magnet pole 2. The path 12 followed by the particle beam illustrated in FIG. 3 is comprised within the gap 7 separating the first and second magnet poles. The gap 7 between the first and second magnet poles thus comprises hill gap portions 7*h* defined between the upper surfaces 3U of two opposite hill sectors 3 and valley gap portions 7*v* defined between the bottom surfaces 4B of two opposite valley sectors 4. The hill gap portions 7*h* have an average gap height, Gh, defined as the average height of the hill gap portions over the areas of two opposite upper surfaces 3U.

Average hill and valley gap heights are measured as the average of the gap heights over the whole upper surface and lower surface of a hill sector and a valley sector, respectively. The average of the valley gap height ignores any opening on the bottom surfaces.

The upper surface 3U is defined by (see FIG. 2):

- an upper peripheral edge 3*up*, said upper peripheral edge being bounded by a first and a second upper distal ends 3*ude*, and being defined as the edge of the upper surface located furthest from the central axis Z;
- an upper central edge 3*uc*, said upper central edge being bounded by a first and a second upper proximal ends 3*upe* and being defined as the edge of the upper surface located closest from the central axis;
- strai
- a second upper lateral edge 3*ul* connecting the second upper distal end and second upper proximal end.

A hill sector 3 further comprises (see FIG. 2):

- a first and second lateral surfaces 3L each extending transversally from the first and second upper lateral edges, to the bottom surfaces of the corresponding valley sectors located on either sides of a hill sector, thus defining a first and second lower lateral edges 311 as the edges intersecting a lateral surface with an adjacent bottom surface, said first and second lower lateral edges each having a lower distal end 31*de* located furthest from the central axis;
- a peripheral surface 3P extending from the upper peripheral edge to a lower peripheral line 31*p* defined as the segment bounded by the lower distal ends 31*de* of the first and second lower lateral edges.

The average height of a hill, Hh, sector is the average distance measured parallel to the central axis between lower and upper lateral edges.

An end of an edge is defined as one of the two extremities bounding a segment defining the edge. A proximal end is the end of an edge located closest from the central axis, Z. A distal end is the end of an edge located furthest from the central axis, Z. An end can be a corner point which is defined as a point where two or more lines meet. A corner point can also be defined as a point where the tangent of a curve changes sign or presents a discontinuity.

An edge is a line segment where two surfaces meet. An edge is bounded by two ends, as defined supra, and defines one side of each of the two meeting surfaces. For reasons of machining tools limitations, as well as for reduction of stress concentrations, two surfaces often meet with a given radius of curvature, R, which makes it difficult to define precisely the geometrical position of the edge intersecting both surfaces. In this case, the edge is defined as the geometric line intersecting the two surfaces extrapolated so as to intersect each other with and infinite curvature (1/R). An upper edge is an edge intersecting the upper surface 3U of a hill sector, and a lower edge is an edge intersecting the bottom surface 4B of a valley sector.

A peripheral edge is defined as the edge of a surface comprising the point located the furthest from the central axis, Z. If the furthest point is a corner point shared by two edges, the peripheral edge is also the edge of a surface which average distance to the central axis, Z, is the largest. For example, the upper peripheral edge is the edge of the upper surface comprising the point located the furthest to the central axis. If a hill sector is compared to a slice of tart, the peripheral edge would be the peripheral crust of the tart.

In an analogous manner, a central edge is defined as the edge of a surface comprising the point located the closest to the central axis, Z. For example, the upper central edge is the edge of the upper surface comprising the point located the closest to the central axis, Z.

A lateral edge is defined as the edge joining a central edge at a proximal end to a peripheral edge at a distal end. The proximal end of a lateral edge is therefore the end of said lateral edge intersecting a central edge, and the distal end of said lateral edge is the end of said lateral edge intersecting a peripheral edge.

Depending on the design of the cyclotron, the upper/lower central edge may have different geometries. The most common geometry is a concave line (or concave curve), often circular, of finite length ($\neq 0$), with respect to the central axis, which is bounded by a first and second upper/lower proximal ends, separated from one another. This configuration is useful as it clears space for the introduction into the gap of the particle beam and other elements. In a first alternative configuration, the first and second proximal central ends are merged into a single proximal central point, forming a summit of the upper surface 3U, which comprises three edges only, the central edge having a zero-length. If a hill sector is again compared to a slice of tart, the pointed tip of the slice would correspond to the central edge thus reduced to a single point. In a second alternative configuration, the transition from the first to the second lateral edges can be a curve convex with respect to the central axis, Z, leading to a smooth transition devoid of any corner point. In this configuration, the central edge is also reduced to a single point defined as the point wherein the tangent changes sign. Usually, even in the first and second alternative configurations, a hill sector does not extend all the way to the central axis, the central area directly surrounding the central axis is cleared to allow insertion of the particle beam or installation of other elements.

As shown is FIG. 2, the first and second lateral surfaces 3L may be chamfered forming a chamfer 3*ec* at the first and second upper lateral edges, respectively. A chamfer is defined as an intermediate surface between two surfaces obtained by cutting off the edge which would have been formed by the two surfaces absent a chamfer. A chamfer may reduce the angle formed at an edge between two surfaces. Chamfers are often used in mechanics for reducing stress concentrations. In cyclotrons, however, a chamfered lateral surface at the level of the upper surface of a hill sector may enhance the focusing of the particle beam as it reaches a hill gap portion 7*h*. The peripheral surface 3P of a hill sector may also form a chamfer at the upper peripheral edge, which may improve the homogeneity of the magnetic field near the peripheral edge.

A cyclotron according to an embodiment of the present disclosure may comprise N=3 to 8 hill sectors 3. For example, as illustrated in the Figures, N=4. For even values of N, the hill sectors 3 and valley sectors 4 must be distributed about the central axis with any symmetry of 2n, with n=1 to N/2. For example, according to a certain aspect, n=N/2, such that all the N hill sectors are identical to one another, and all the N valley sectors are identical to one another. For odd values of N, the hill sectors 3 and valley sectors 4 may be distributed about the central axis with a symmetry of N. For example, according to a certain aspect, the N hill sectors 3 may be uniformly distributed around the central axis for all N=3-8 (i.e., with a symmetry of N). The first and second magnet poles 2 may be positioned with their respective upper surfaces 3U facing each other and symmetrically with respect to the median plane MP normal to the respective central axes Z of the first and second magnet poles 2, which are coaxial.

The shape of the hill sectors may be often wedge shaped like a slice of tart (often, as discussed supra, with a missing tip) with the first and second lateral surfaces 3L converging from the peripheral surface towards the central axis Z (usually without reaching it). The hill azimuthal angle, $\alpha h$, corresponds to the converging angle, measured at the level of the intersection point of the (extrapolated) upper lateral edges of the lateral surfaces at, or adjacent to, the central axis Z. The hill azimuthal angle, $\alpha h$, may be between 360°/2N±10°, for example, between 360°/2N±5° or between 360°/2N±2°.

The valley azimuthal angle $\alpha v$, measured at the level of the central axis Z may be between 360°/2N±10°, for example, between 360°/2N±5° or between 360°/2N±2°. The valley azimuthal angle $\alpha v$ may be equal to the hill azimuthal angle, $\alpha h$. In case of a degree of symmetry of N, $\alpha v = 360°/N - \alpha h$; for example, for N=4, $\alpha v$ is the complementary angle of $\alpha h$, with $\alpha v = 90° - \alpha h$.

The largest distance, Lh, between the central axis and a peripheral edge may be between 200 and 2000 mm, for example, between 400 and 1000 mm or between 500 and 800 mm. For a 18 MeV proton cyclotron, the longest distance, Lh, is usually less than 750 mm, and may be of the order of 500 to 750 mm, typically 520 to 550 mm. The upper peripheral edge has an azimuthal length, Ah, measured between the first and second upper peripheral ends, and can be approximated to, $Ah = Lh \times \alpha h$ [rad].

The two magnet poles 2 and solenoid coils 14 wound around each magnet pole form an (electro-)magnet which generates a magnetic field in the gap 7 between the magnetic poles that guides and focuses the beam of charged particles (=particle beam) along a spiral path 12 illustrated in FIG. 3, starting from the central area (around the central axis, Z) of the cyclotron, until it reaches a target energy, for example of 18 MeV, whence it is extracted. As discussed supra, the magnet poles are divided into alternating hill sectors and valley sectors distributed around the central axis, Z. A strong magnetic field is thus created in the hill gap portions 7*h* of average height Gh within the hill sectors and a weaker magnetic field is created in the valley gap portions 7*v* of average height Gv>Gh, within the valley sectors thus creating vertical focusing of the particle beam.

When a particle beam is introduced into a cyclotron, it is accelerated by an electric field created between high voltage electrodes called dees (not shown), and ground voltage electrodes attached to the lateral edges of the poles, positioned in the valley sectors, where the magnetic field is weaker. Each time an accelerated particle penetrates into a hill gap portion 7*h* it has a higher speed than it had in the preceding hill sector. The high magnetic field present in a hill sector deviates the trajectory of the accelerated particle to follow an essentially circular path of radius larger than it followed in the preceding hill sector. Once a particle beam has been accelerated to its target energy, it is extracted from the cyclotron at a point called point of extraction PE, as shown in FIG. 3. For example, energetic protons, $H^+$, may be extracted by driving a beam of accelerated $H^+$ ions through a stripper consisting of a thin foil sheet of graphite. A $H^-$ ion passing through the stripper loses two electrons to become a positive, $H^+$. By changing the sign of particle charge, the curvature of its path in the magnetic field changes sign, and the particle beam is thus led out of the cyclotron towards a target (not shown). Other extracting systems are known by the persons skilled in the art and the type and details of the extraction system used is not essential to some embodiments of the present disclosure. Usually, a point of extraction is located in a hill gap portion 7*h*. A cyclotron may comprise several points of extraction in a same hill portion. Because of the symmetry requirements of a cyclotron, more than one hill sector may comprise an extraction point. For degrees of symmetry of N, all N hill sectors comprise the same number of points of extraction. The points of extraction may be used individually (one only at a time) or simultaneously (several at a time).

Gradient Corrector

Figure 4A:
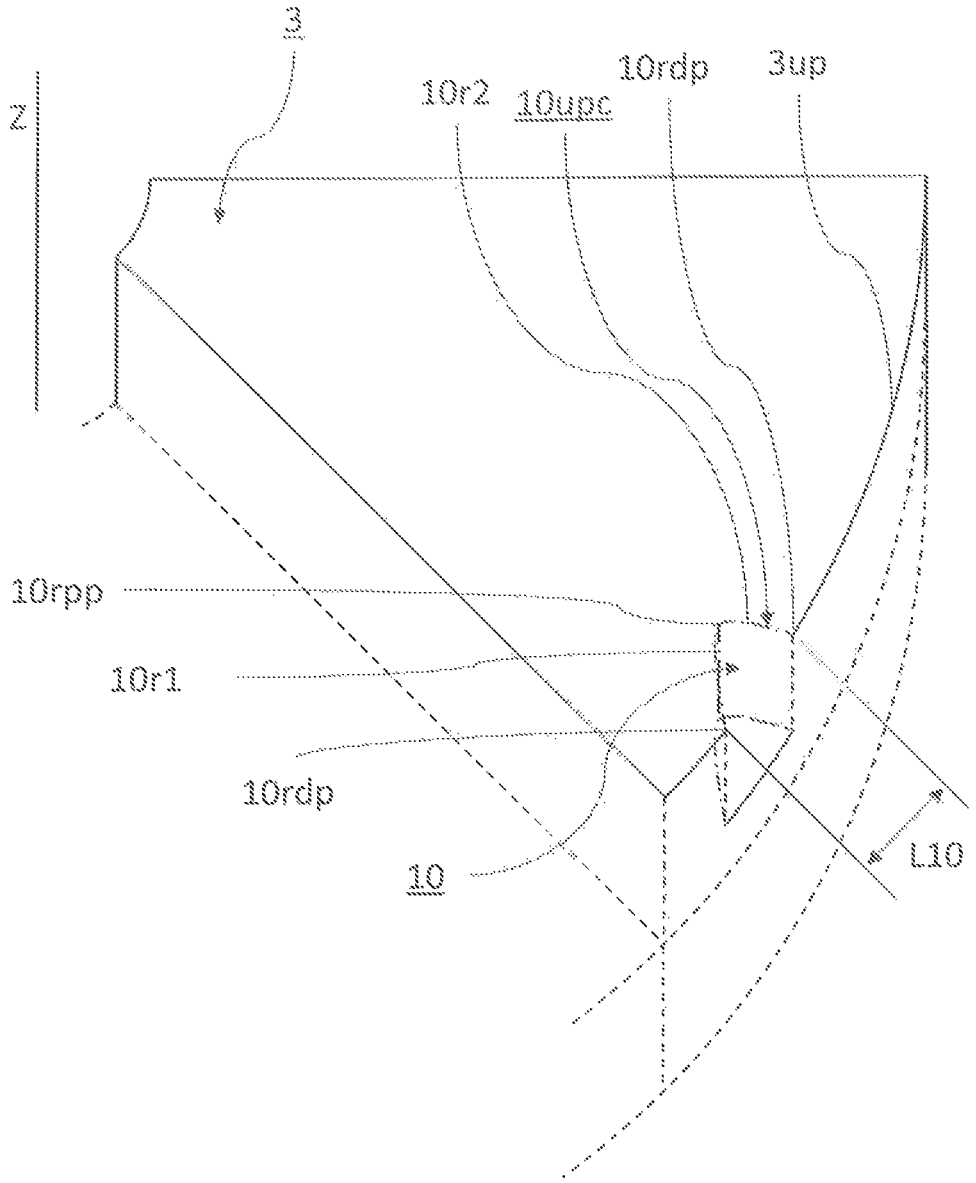
FIG. 4A shows an example of a hill sector according to example embodiments of the present disclosure comprising a gradient corrector.
Figure 4B:
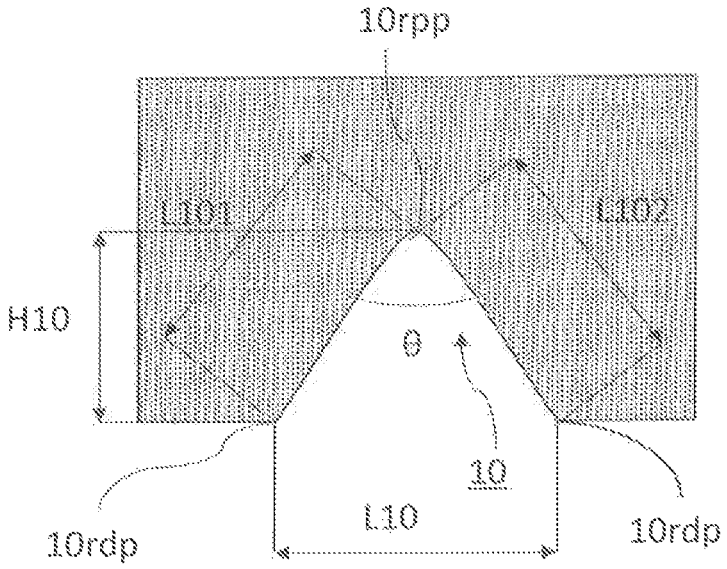
FIG. 4B shows a different view of the example hill sector of FIG. 4A according to example embodiments of the present disclosure comprising a gradient corrector.

FIG. 4A and FIG. 4B show an example of an embodiment of a magnet pole for a cyclotron comprising N=4 hill sectors and N=4 valley sectors comprising a bottom surface, said hill sectors and valley sectors alternatively distributed around a central axis, Z, with a symmetry of N=4. A hill sector according to such an embodiment comprises a first and second lateral surfaces 3L, a peripheral surface 3P and an upper surface 3U such as defined above. The upper peripheral edge 3*up* of the upper surface of at least one hill sector may comprise a convex portion adjacent to a concave portion with respect to the central axis defining a recess extending partially over a portion of the peripheral surface of the corresponding hill sector. In some embodiments, the upper peripheral edge 3*up* of the upper surface of at least one hill sector comprises 2 convex portions separated by a concave portion.

Because of the symmetry requirements of 2n for even values of N and of N for odd values of N, discussed supra, the same symmetry must apply to the presence or not of a concave portion with respect to the central axis on the upper peripheral edges of the various hill sectors. Therefore, the upper peripheral edge of each hill sector, for example, may comprise a concave portion 3*upc* with respect to the central axis defining a recess 10 extending partially over the peripheral surface of the corresponding hill sector between two convex portions.

The term "concave" means curving in or hollowed inward. The concave portion with respect to the central axis of an edge is a portion of the edge curving towards the central axis. This term is opposed to the term "convex" that means curving out of or extending outward from the central axis.

The position of the recess can either be separated from the first and second lateral edges, or adjacent to the first or second lateral edge. In some embodiments, a hill sector comprises at least one recess separated from the lateral edges.

In prior art cyclotrons, protruding gradient correctors were often used. Protruding gradient correctors have several drawbacks:

- increase of the volume of the vacuum chamber,
- increase of the volume of the yoke, and of the whole cyclotron,
- increase of the weight of the cyclotron,
- difficulty of precise positioning of the gradient correctors which must be done manually,
- outwards deviation of the magnetic field.

Figure 5A:
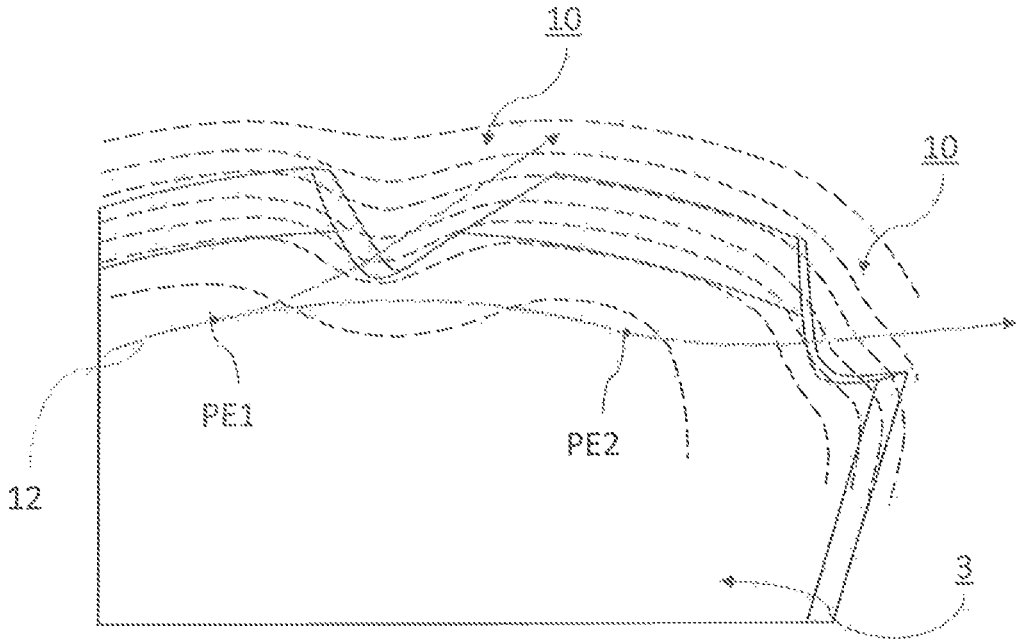
FIG. 5A shows an example of lines of a magnetic field with a gradient corrector.
Figure 5B:
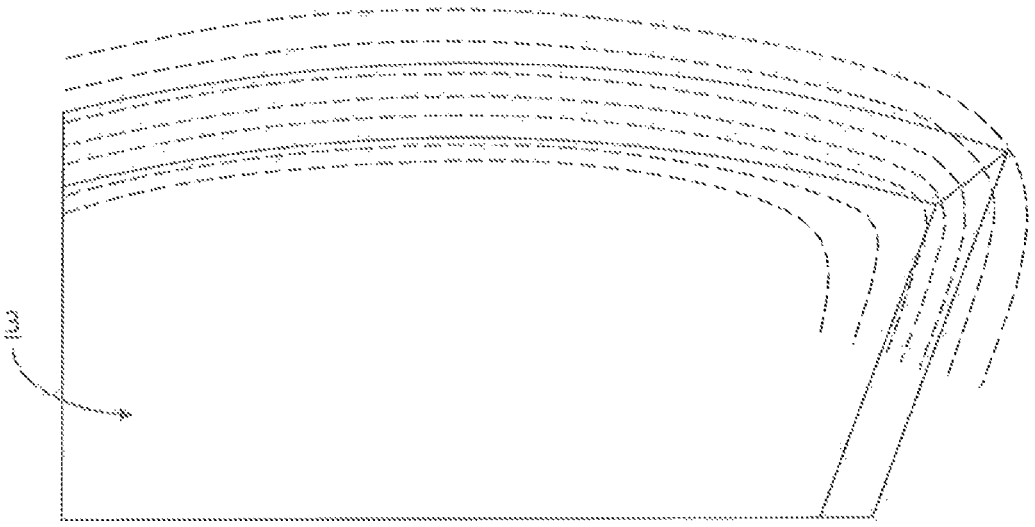
FIG. 5B shows an example of lines of a magnetic field without a gradient corrector.

Using recessed gradient correctors instead of protruding gradient correctors may have several advantages. First, it may allow the reduction of the size of the vacuum chamber hosting the magnet poles leading to a decrease of energy required for evacuating the gases from the vacuum chamber and reducing the time of the gas evacuation. Second, the overall weight of the cyclotron may be decreased because, on the one hand, the weight of the hill sectors is slightly reduced instead of being increased and, on the other hand, the overall diameter of the inner surface of flux return yoke is decreased. Third, the position of the recesses may be precisely manufactured and positioned by numerically controlled machining allowing the optimization of the angle at which the particle beam crosses the peripheral edge of the hill sector. Fourth, when protruding gradient correctors deviate the magnetic field outwards, the magnetic field may be deviated inwards by recessed gradient correctors resulting in an inwards shift of the last cycles of the particles path, further away from the peripheral edge of the hill sector, where the magnetic field is more uniform than close to the peripheral edge. FIG. 5A shows an example of the lines of the magnetic field deviated by the recessing gradient corrector and FIG. 5B shows an example of the lines of the magnetic field without any gradient corrector. It may therefore be easier and more predictable to control the properties of the extracted particle beam, and particularly the focusing thereof. This deviation towards the acceleration area may also allow the power fed to the coils to be decreased.

In some embodiments, the upper peripheral edge 3*up* may comprise a first and a second recess distal points 10*rdp*, defining the boundaries of a recess, and which are defined as the points where the tangent of the upper peripheral edge changes sign or presents a discontinuity. The first and second recess distal points may be separated from one another by a distance L10. The recess may also comprise a recess proximal point 10*rpp* defined as the point of the recess located closest to the central axis, Z. The first and second recess distal points 10*rdp* join the recess proximal point 10*rpp* by a first and second recess converging edges 10*rc*.

The recess depth, H10, is defined as the height of the triangle formed by the first and second recess distal points 10*rdp* and the recess proximal point 10*rpp*, and passing by the recess proximal point 10*rpp*. The depth of the recess, H10 may be between 3% and 30%, for example, between 5% and 20% or between 8% and 15% of the azimuthal length, Ah, of the upper peripheral edge. In some embodiments, the ratio of the recess depth, H10, to the largest distance, Lh, between the central axis and a peripheral edge of a hill sector, H10/Lh, may be between 2% and 20%, for example, between 4% and 15% or between 6% and 10%.

The upper peripheral edge 3*up* has an azimuthal length, Ah, measured between the first and second upper distal ends 3*ude*. The first recess converging edge 10*r*1 joining the first recess distal point to the recess proximal point has a length L101 and the second recess converging edge 10*r*2 joining the second recess distal point to the recess proximal point has a length L102. The lengths L101 and L102 of the first and second recess converging edges may be between 5% and 30% of the azimuthal length, Ah, of the upper peripheral edge. For example, the length L101 may be equal ±40% to the length L102 (L101=L102±40%).

In some embodiments, the distance L10 between first and second recess distal points ranges between 5% and 50%, for example, between 10% and 30% or between 15% and 20% of the azimuthal length, Ah, of the upper peripheral edge.

In some embodiments, the recess also extends over a portion of the peripheral surface 3P from the upper peripheral edge 3*up* towards the lower peripheral line 31*p*. The recess may thus extend over the peripheral surface over a fraction, of a height of the peripheral surface measured parallel to the central axis between the upper peripheral edge and lower peripheral line. The fraction, may be between 25% and 100%, for example, between 40% and 75% or between 45% and 55%.

Figure 6:
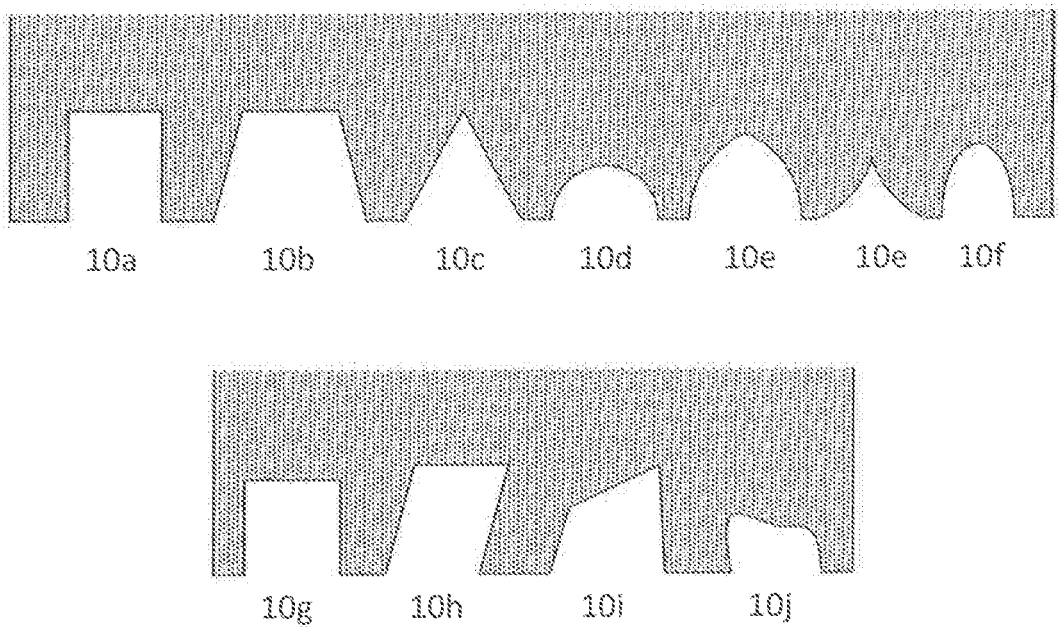
FIG. 6 shows examples of geometries of the concave portion of the upper peripheral line of a hill sector according to example embodiments of the present disclosure.

As illustrated in FIG. 6, the concave portion of the upper peripheral edge may have any of the following geometries open between the first and second recess distal points: (a) a rectangle, (b) a trapeze, (c) a triangle having straight edges or curved (inwards or outwards) edges, (d) an arc of a circle, (e) two arcs of a circle, (f) a parabola, (g) a square, (h) a parallelogram, (i) a polygon, (j) a smooth curve. Basically, any geometry determined by numerical analysis can be implemented. For example, in the case of a trapeze, the small base can comprise the recess proximal point 10*rpp*, and the large base can be defined by the first and second recess distal points 10*rdp*. Alternatively, the small base can be defined by the first and second recess distal points 10*rdp*, and the large base can comprise the recess proximal point 10*rpp*. A triangle can be scalene, isosceles or equilateral. It can also be right, with the right angle formed at the recess proximal point 10*rpp*. In the case of two (or more) arcs of a circle, they can be curved inwards ((e) right) or outwards ((e) left). The concave portion may be designed such that one edge thereof intersects the extraction path of a particle beam with an angle of 80-100°, for example, 85-95° or 90°.

Figure 7:
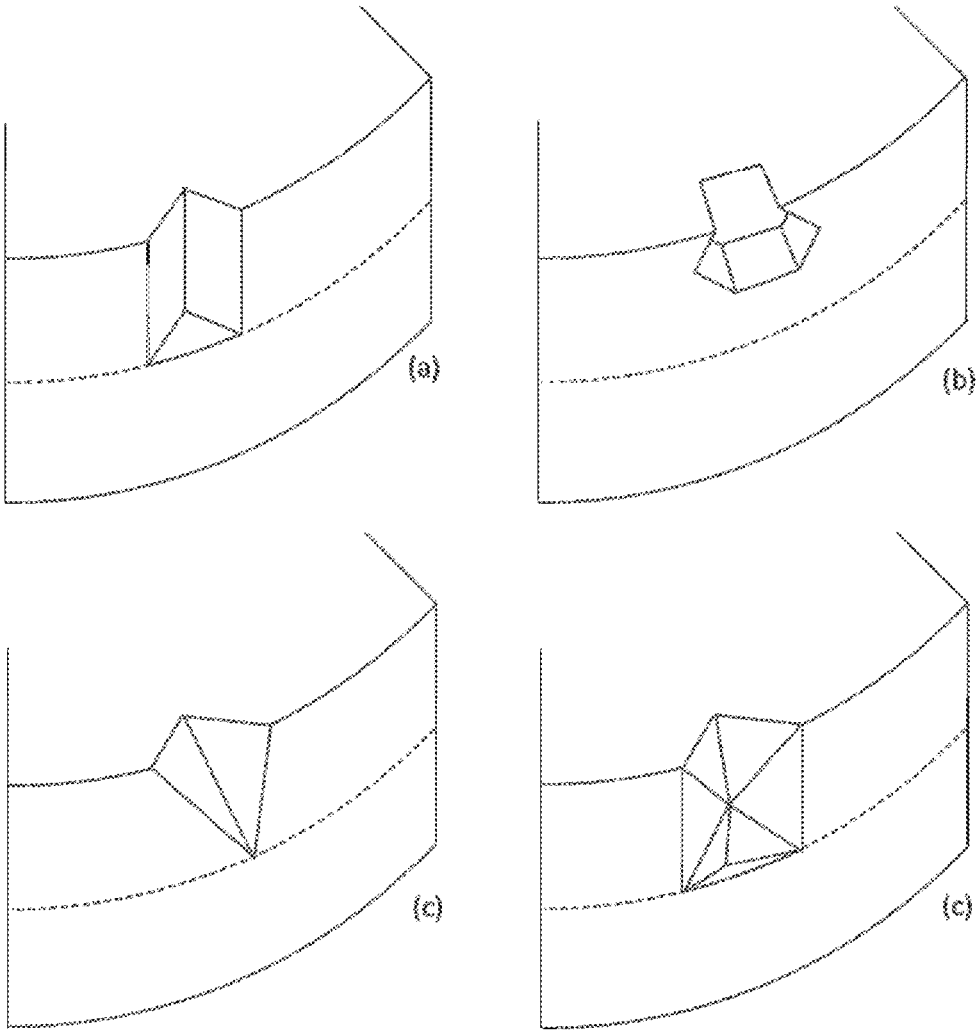
FIG. 7 shows examples of geometries of the recess according to example embodiments of the present disclosure.

In some embodiments, a recess 10 extends over a portion of the peripheral surface parallel to the central axis. Alternatively, it may extend downwards from the upper surface with an angle with the central axis, Z. The distance L10 and/or the height H10 may increase or decrease independently of one another or simultaneously along the height of the peripheral surface. The area of the cross-section of the recess normal to the central axis, Z, may thus decrease or increase with the distance from the upper surface. In other embodiments, the geometry and the area of the cross-section of the recess can change over the peripheral surface. The height of the recess may also vary over the peripheral surface. FIG. 7 illustrates some examples of geometries of recesses. For example, the recess may have a shape of: (a) a prism extending from the upper surface parallel to the central axis, (b) a prism extending from the peripheral surface normal to the central axis, (c) a (portion of) pyramid, or more complex volumes extending over the peripheral surface.

In some embodiments, the recess may be generally wedge-shaped with the first and second recess converging edges being straight (or slightly curved inwards or outwards) lines. The tip of the wedge corresponds to the recess proximal point and points at the general direction of the central axis. The converging angle, θ, at the tip of the wedge may be between 70° and 130°, for example, between 80° and 110° or 90°±5°. The expressions "inwards" and "outwards" used herein are to be understood as "towards" or "away from" the central axis, respectively.

More generally, the converging portion of the wedge-shaped recess can have one of the following geometries:

- a sharp corner forming a triangular recess, corresponding to the wedge shaped recess discussed supra;
- a straight edge forming a trapezoidal recessed wedge; or
- a rounded edge wedge forming an arched recess.

Embodiments of the present disclosure also relate to a cyclotron comprising magnet poles as defined supra. As described supra, a cyclotron accelerates a particle beam over a given path until a first point of extraction whence the particle beam is driven out of the cyclotron with a given energy. The hill gap portion between a pair of hill of the first and second magnet poles of a cyclotron has an average height, Gh. In some embodiments, the ratio of the distance L10 between first and second recess distal points 10*rdp* to the height of hill gap portion Gh, may be between 1 and 20, for example, between 2 and 10 or 3 and 5. For example, for a hill gap of height Gh=20-40 mm, the distance L10, can be of the order of 10-100 mm, yielding a ratio L10/Gh which may be between 1-5, for example, between 3 and 3.5, i.e. Gh/L10≤1.

In some embodiments, a point of extraction is located within a hill gap portion adjacent to the peripheral edges of a pair of opposed hill sectors. A recess may be located downstream from said first point of extraction wherein downstream is defined with respect to the direction of the particle beam. The recess 10 may be precisely machined with respect to the point of extraction and to the extraction path such that the particle beam intersects the first converging recess edge 10*r*1 with an angle of 90°±15°. The particle beam may thus leave the hill gap portion substantially normal to the magnetic field, which may improve the focusing of the extracted particle beam. The position and the geometry of the recess are determined by numerical computation and/or testing.

Figure 8:
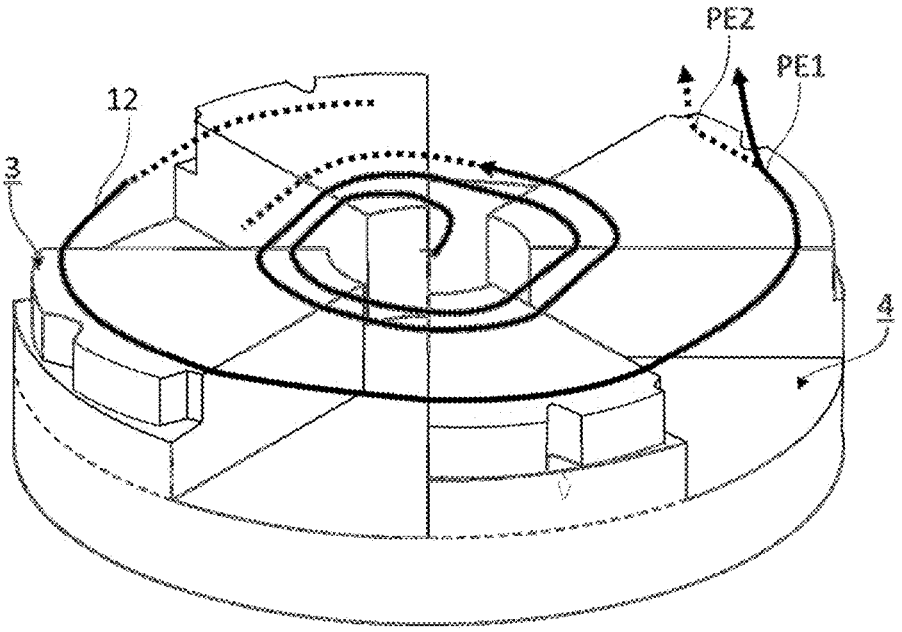
FIG. 8 shows an example of a magnet pole according to example embodiments of the present disclosure having two recesses and two points of extraction.

As shown in FIG. 8, the cyclotron may further comprise a second point of extraction, PE2, located downstream from the first point of extraction, PE1, and within the same hill gap portion of the same pair of opposed hill sectors. The particle beam may be driven out of the cyclotron at said second point of extraction with the same energy as at said first point of extraction. In this case, the hill sector comprising the two extraction points, also comprises two recesses, each located downstream from a corresponding point of extraction.

Figure 9:
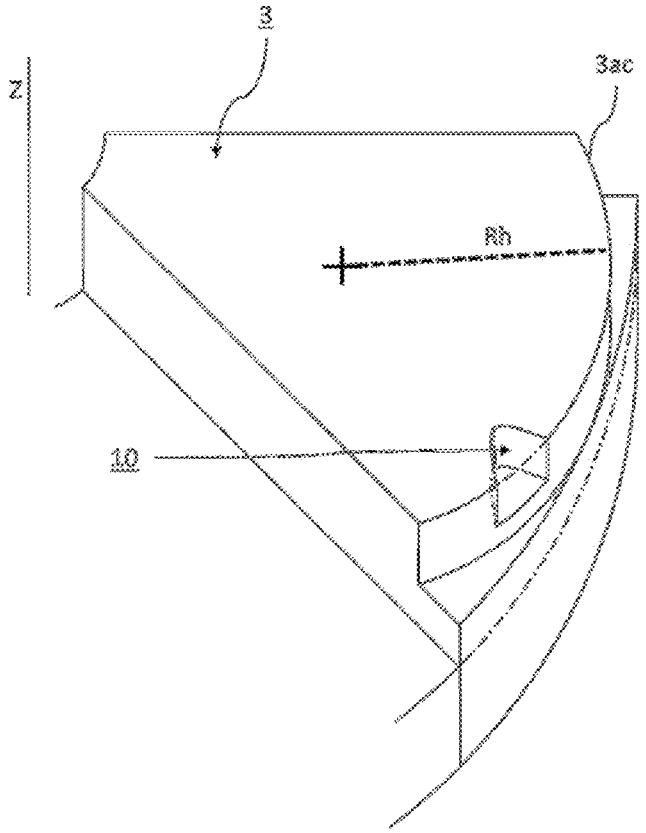
FIG. 9 shows another example of a hill sector according to example embodiments of the present disclosure comprising an improved upper peripheral edge design of a hill sector.

FIG. 9 shows an example of an embodiment of a magnet pole for a cyclotron according to the present disclosure. In this embodiment, the upper peripheral edge 3*up* is bounded by a first and a second upper distal ends, and the upper peripheral edge of a hill sector comprises an arc of a circle 3*ac* whose centre is offset with respect to the central axis, and whose radius, Rh, is not more than 85% of a distance, Lh, from the central axis to a midpoint of the upper peripheral edge, which is equidistant to the first and second upper distal ends (Rh/Lh≤85%).

In some embodiments, the ratio Rh/Lh of the radius, Rh, to the distance Lh, may be not more than 75% (Rh/Lh≤75%), for example, not more than 65% (Rh/Lh≤65%).

Embodiments in which the upper peripheral edge comprises an arc of a circle whose centre is offset with respect to the central axis may homothetically approximate at least a portion of the upper peripheral edge to the highest energy (=last) orbit of the spiral path 12 in a hill gap portion 7*h* of the cyclotron. By "homothetically approximate the orbit" is meant that the arc of circle portion of the upper peripheral edge and the last orbit of particle adjacent to the point of extraction are both arcs of circle sharing the same centre with different radii. The arc of the circle may thus be approximately parallel to the portion of said last orbit directly adjacent to and upstream from the extraction point. The length of the path of the extracted orbit and the angle between the orbit and the upper peripheral edge may become independent of the azimuthal position of the extracting system (for example a stripper). In consequence, the characteristics of the extracted beam may be (nearly) independent of the position of the point of extraction.

In some embodiments, the arc of the circle extends from the first upper distal end to the second upper distal end of the upper peripheral edge, thus defining the whole peripheral edge of a hill sector and the centre of the arc of the circle lies on the bisector of the upper surface, said bisector being defined as the straight line, joining the central axis to the midpoint of the upper peripheral edge.

In some embodiments, the peripheral surface forms a chamfer adjacent to the upper peripheral edge.

As described supra, a cyclotron accelerates the particle beam over a given path until a first point of extraction whence the particle beam can be driven out of the cyclotron with a given energy. In certain aspects, a hill sector may comprise more than one point of extraction, for example, two. The arc of the circle portion of the upper peripheral edges of two opposite hill sectors with respect to the median plan MP, of two magnet poles may be parallel to, and reproduce homothetically, a portion of the given path directly upstream of the first point of extraction. The arc of the circle may share the same centre as, and be parallel to, a portion of the given path over the whole peripheral edge. The terms "upstream" and "downstream" are defined with respect to the direction of the particle beam.

When the particle beam has reached its target energy, it may be extracted at a point of extraction, and it may then follow an extraction path downstream of the point of extraction. A part of this extraction path may lie between the first and second magnet poles and may thus be comprised within the hill gap portion and subjected to the magnetic field. If the pair of opposite hill sectors comprises a first and a second points of extraction, the particle beam may be extracted either at the first or at the second point of extraction or at both. The particle beam may then follow either a first or a second extraction path downstream of the first or second point of extraction. With the circular geometry of at least a portion of the upper peripheral edge according to the present embodiment, the length of the extraction path comprised within the gap downstream of the first point of extraction, L1, and the length of the extraction path comprised within the gap downstream of the second point of extraction, L2, may be substantially equal.

Embodiments having the same length of extraction paths downstream of the first and second points of extraction may ensure that the particle beam extracted from one point of extraction has similar optical properties as the one extracted from the second point of extraction.

Figure 10A:
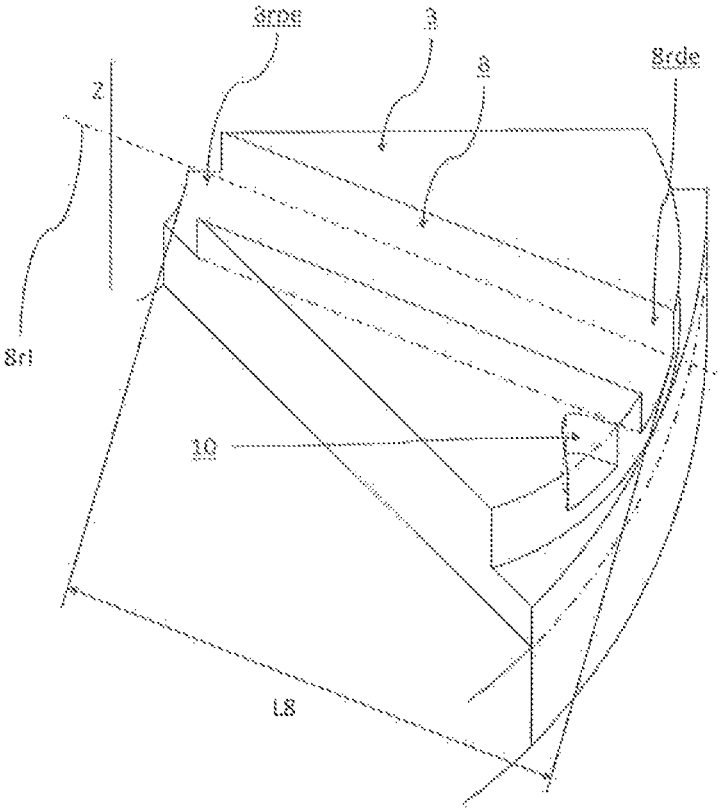
FIG. 10A shows a third example of a hill sector according to example embodiments of the present disclosure and having a recess.
Figure 10B:
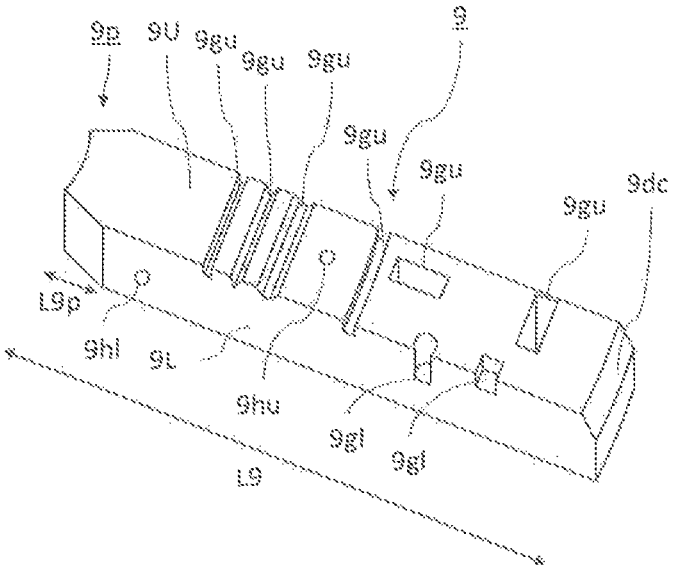
FIG. 10B shows a third example of a hill sector according to example embodiments of the present disclosure and having a pole insert.

FIG. 10A shows an example of an embodiment of a magnet pole for a cyclotron wherein the upper surface of at least one hill sector further comprises:

- a recess 8 extending over a length L8 between a recess proximal end 8*rpe* and a recess distal end 8*rde* along a longitudinal axis 8*rl* intersecting the upper peripheral edge and the upper central edge; said recess is separate from the first and second upper lateral edges over at least 80% of its length, L8, and
- as depicted in FIG. 10B, a pole insert 9 having a geometry fitting said recess and being positioned in, and reversibly coupled to said recess.

The term "fitting" means that the pole insert has a general shape able to be precisely inserted into and nested in the recess.

In prior art cyclotrons comprising pole inserts, the pole inserts were often positioned in a recess machined off a lateral edge of the upper surface of the hill sectors. Access to such pole inserts is, however, rendered difficult by part of the RF accelerating system overlapping the upper lateral edge area. Access to such pole inserts requires removing the overlapping part of the RF system first. By positioning a pole insert on the upper surface, it may be accessed easily and directly for removal, machining and re-insertion into the recess. With the present embodiment, it may, therefore, be much easier and efficient to reach the optimal insert topography yielding the predicted magnetic field and particle path.

In some embodiments, all pole inserts have the same shape and are made of the same material. In certain aspects, the pole insert is made of the same material as the corresponding hill sector.

In some embodiments, the recess extends along a longitudinal axis intersecting the central axis, and it is open ended at both ends and extends from the upper central edge all the way to the upper peripheral edge. In yet another embodiment, the longitudinal axis intersects the upper peripheral edge at a point located at equal distance from the first and second upper distal ends, and wherein the first and second upper distal ends are preferably symmetrical with respect to the longitudinal axis. For example, except for the proximal portion 9*p* adjacent to the central edge, the pole insert has a general parallelepiped shape, as illustrated in FIG. 6B.

In the embodiment of FIG. 6A, the recess extends to and is open ended at the upper peripheral edge, the distal end of the pole insert 9*dc* forms a portion of the upper peripheral edge. The portion of the upper peripheral edge formed by the pole insert may be not more than 10%, for example, not more than 5% of the length, Ah, of the upper peripheral edge. This distal end may form a chamfer at the peripheral surface.

The pole insert may be nested in the recess and may be reversibly fastened to the corresponding hill sector. For example, it may be coupled to the hill sector with screws.

As discussed supra, the pole insert may have a prismatic geometry along the longitudinal axis over at least 80% of its length, L9, excluding the converging proximal portion 9*p*, of length L9*p*. In embodiments in which the ridges between the hill upper surface 3U and the hill lateral surfaces are chamfered, the corresponding ridges of the proximal portion of the recess may be chamfered too.

The topography, illustrated in FIG. 6, of the pole insert upper surface 9U and/or first and second lateral surfaces 9L may be machined to form grooves 9*gu*, 9*gl* either transverse, or parallel to the longitudinal axis, of the upper surface or of a lateral surface. The grooves may extend along a straight, curved or broken line. Alternatively, holes **9*hu*, 9*hl*** may be drilled through the surfaces. The holes can be blind holes (i.e., of finite depth) or can be through holes. As explained supra, each hill sector may comprise a pole insert, and the pole inserts may thus be machined individually or aligned side by side and all machined together. The resulting aspect of the machined pole insert may differ considerably from its aspect before machining.

In conclusion, embodiments of the present disclosure may provide advantages, for example, allowing the reduction of the size of the vacuum chamber and a decrease of the overall weight of the cyclotron. In addition, embodiments of the present disclosure may allow the position of the recesses to be precisely manufactured and positioned. Furthermore, embodiments of the present disclosure may allow for the magnetic field to be deviated inwards by recessed gradient correctors resulting in an inwards shift of the last cycles of the particles path where the magnetic field is more uniform than close to the peripheral edge. Accordingly, it may be easier and more predictable to control the properties of the extracted particle beam, and particularly the focusing thereof.

| Ref # | Feature |
|---|---|
| 1 | Cyclotron |
| 2 | Magnet pole |
| 3 | Hill sector |
| 4 | Valley sector |
| 5 | Yokes |
| 6 | Flux return yoke |
| 7 | Gap |
| 8 | Recess |
| 9 | Pole insert |
| 10 | Recess |
| 12 | Spiral path |
| 14 | Coils |
| 3ac | Arc of circle |
| 3ec | Chamfered edge |
| 3L | Lateral surface |
| 3lde | Lower distal end of lower lateral edge |
| 3ll | Lower lateral edge |
| 3p | Lower peripheral line |
| 3P | Peripheral surface |
| 3U | Upper surface |
| 3uc | Upper central edge |
| 3ude | Upper distal end of upper lateral edge |
| 3ul | Upper lateral edge |
| 3up | Upper peripheral edge |
| 3upc | Upper peripheral edge concave portion |
| 3upe | Upper proximal end of upper lateral edge |
| 4B | Bottom surface |
| 7h | Hill gap portion |
| 7v | Valley gap portion |
| 8lr | Recess longitudinal axis |
| 8rde | Recess distal end |
| 8rpe | Recess proximal end |
| 9dc | Pole insert distal end chanfered |
| 9gl | Pole insert groove lateral |
| 9gu | Pole insert groove upper |
| 9hl | Pole insert hole lateral |
| 9hu | Pole insert hole upper |
| 9L | Pole insert lateral surface |
| 9lp | Pole insert proximal portion length |
| 9p | Pole insert proximal portion |
| 9pe | Pole insert proximal edge |
| 9U | Pole insert upper surface |
| 9pe | Pole insert proximal edge |
| 9s | Screw |
| 9U | Pole insert upper surface |
| 10r1 | Recess converging edge (1st) |
| 10r2 | Recess converging edge (2d) |
| 10rdp | Recess distal point |
| 10rpp | Recess proximal point |
| Ah | Azimuthal length of the upper peripheral edge |

-continued

| Ref # | Feature |
|---|---|
| dh | Distance upper peripheral edge - highest orbit |
| Gh | Gap height at hill |
| Gv | Gap height at valley |
| H10 | Recess height |
| Hh | Hill height |
| L1, L2 | Length of the extraction path comprised within the gap downstream of a point of extraction |
| L10 | Length between first and second recess distal points |
| L101, L102 | Length of the recess converging edge |
| L8 | Recess length |
| L9 | Pole insert length |
| L9p | Pole insert length of proximal portion |
| Lh | Distance between the central axis and a peripheral edge |
| MP | Median plane |
| PE | Point of extraction |
| Rh | Radius of radial pole contour |
| Z | Central axis |
| αh | Hill azimuthal angle |
| αv | Valley azimuthal angle |

The invention claimed is:

1. A magnet pole for use in a cyclotron, comprising:

at least three hill sectors, each associated with a magnetic field; and a same number of valley sectors comprising a bottom surface, where each valley sector is associated with a magnetic field, where the magnetic fields of the hill sectors are stronger than the magnetic fields of the valley sectors, said hill sectors and valley sectors being alternatively distributed around a central axis, and each hill sector comprising:

an upper surface defined by:

an upper peripheral edge, said upper peripheral edge being bounded by a first and a second upper distal ends, and being defined as the edge of the upper surface located furthest from the central axis, an upper central edge, said upper central edge being bounded by a first and a second upper proximal ends and being defined as the edge of the upper surface located closest from the central axis, a first upper lateral edge connecting the first upper distal end and first upper proximal end, and a second upper lateral edge connecting the second upper distal end and second upper proximal end;

a first lateral surface and a second lateral surface, each extending transversally from the first and second upper lateral edges to the bottom surfaces of corresponding valley sectors located on either sides of a hill sector, thus defining a first and second lower lateral edges as the edges intersecting a lateral surface with an adjacent bottom surface, said first and second lower lateral edges each having a lower distal end located furthest from the central axis; and a peripheral surface extending from the upper peripheral edge to a lower peripheral line defined as the segment bounded by the lower distal ends of the first and second lower lateral edges, wherein the upper peripheral edge of at least one hill sector comprises a concave portion with respect to the central axis defining a recess extending at least partially over a portion of the peripheral surface of a corresponding hill sector.

2. The magnet pole according to claim 1, wherein the recess is generally wedge-shaped with a first converging line and a second converging line each extending away from the upper peripheral edge, with a converging angle between 70° and 130°.

3. The magnet pole according to claim 2, wherein the recess has a converging portion away from the upper peripheral edge, said converging portion being at least one of a sharp corner forming a triangular recess; a straight edge forming a trapezoidal recess; or a rounded edge forming an arched recess.

4. The magnet pole according to claim 2, wherein the converging angle is between 80° and 110°.

5. The magnet pole according to claim 2, wherein the converging angle is 90°±5°.

6. The magnet pole according to claim 1, wherein the upper peripheral edge has an azimuthal length, and wherein the concave portion extends between 3% and 30% of the azimuthal length.

7. The magnet pole according to claim 6, wherein the concave portion extends between 5% and 20% of the azimuthal length.

8. The magnet pole according to claim 6, wherein the concave portion extends between 8% and 15% of the azimuthal length.

9. The magnet pole according to claim 1, wherein the recess is separated from the first and second upper lateral edges.

10. The magnet pole according to claim 1, wherein the recess is adjacent to the first upper lateral edge.

11. The magnet pole according to claim 1, wherein the recess extends over a portion of the peripheral surface corresponding to a fraction of a height of the peripheral surface measured parallel to the central axis between the upper peripheral edge and the lower peripheral line, wherein the fraction is between 25% and 75%.

12. The magnet pole according to claim 11, wherein the fraction is between 40% and 60%.

13. The magnet pole according to claim 11, wherein the fraction is between 45% and 55%.

14. The magnet pole according to claim 1, wherein the peripheral surface forms a chamfer adjacent to the upper peripheral edge.

15. The magnet pole according to claim 1, wherein the upper peripheral edge is an arc of a circle whose centre is offset with respect to the central axis, and whose radius is not more than 85% of a distance from the central axis to a midpoint of the upper peripheral edge, wherein the midpoint is equidistant to the first and second upper distal ends.

16. A cyclotron for accelerating a particle beam over a given path within a gap, the cyclotron comprising:

a first magnet pole and a second magnetic pole, wherein at least one of the first and second magnetic poles comprises:

at least three hill sectors, each associated with a magnetic field; and a same number of valley sectors comprising a bottom surface, where each valley sector is associated with a magnetic field, where the magnetic fields of the hill sectors are stronger than the magnetic fields of the valley sectors, said hill sectors and valley sectors being alternatively distributed around a first central axis, and each hill sector comprising:

an upper surface defined by an upper peripheral edge bounded by a first and a second upper distal ends and being defined as the edge of the upper surface located furthest from the first central axis, an upper central edge bounded by a first and a second upper proximal ends and being defined as the edge of the upper surface located closest from the first central axis, a first upper lateral edge connecting the first upper distal end and first upper proximal end, and a second upper lateral edge connecting the second upper distal end and second upper proximal end;

a first lateral surface and a second lateral surface, each extending transversally from the first and second upper lateral edges to the bottom surfaces of corresponding valley sectors located on either sides of a hill sector, thus defining a first and second lower lateral edges as the edges intersecting a lateral surface with an adjacent bottom surface, said first and second lower lateral edges each having a lower distal end located furthest from the first central axis; and a peripheral surface extending from the upper peripheral edge to a lower peripheral line defined as the segment bounded by the lower distal ends of the first and second lower lateral edges, wherein the upper peripheral edge of at least one hill sector comprises a concave portion with respect to the first central axis defining a first recess extending at least partially over a portion of the peripheral surface of a corresponding hill sector.

17. A cyclotron according to claim 16, wherein the recess has a first and a second recess distal points, said first and second recess distal points being separated from one another by a distance, and wherein a hill gap portion between a pair of hill sectors of the first and second magnet poles has an average height, and wherein the ratio of the average height to the length is between 5 and 100%.

18. A cyclotron according to claim 16, further comprising a point of extraction located in a hill gap portion between two opposite upper surfaces of hill sectors of the first and second magnet poles, wherein:

the given path of the particle beam is an outward spiral path cycling about the first central axis until said first point of extraction whence the particle beam is driven out of the cyclotron with a given energy along an extraction path, the first recess is located downstream from said point of extraction, and the extraction path exits the corresponding hill gap portion by intersecting the recess at an angle between 80° and 100°.

19. A cyclotron according to claim 18, further comprising:

a second point of extraction in a hill sector defining a second extraction path; and the second recess is located downstream from the second point of extraction, wherein the second extraction path exits the corresponding hill gap portion by intersecting the second recess at an angle between 80° and 100°.

20. A cyclotron according to claim 19, wherein the first and second points of extraction are located on the same hill gap portion.

* * * * *